US005317301A

United States Patent [19]

DeVolpi

[11] Patent Number: 5,317,301

[45] Date of Patent: May 31, 1994

[54] JOY STICK

[76] Inventor: Dean DeVolpi, 603 Columbine, Lisle, Ill. 60532

[21] Appl. No.: 913,200

[22] Filed: Jul. 15, 1992

[51] Int. Cl.[5] ..... H01C 10/16

[52] U.S. Cl. ..... 338/128; 338/200

[58] Field of Search ..... 338/128, 306, 200; 200/175, 176, 177

[56] References Cited

U.S. PATENT DOCUMENTS 3,905,097 9/1975 Beetle ..... 338/128 X 4,382,166 5/1983 Kim .

4,733,214 3/1988 Andresen ..... 338/128

5,087,904 2/1992 DeVolpi .

*Primary Examiner*—Marvin M. Lateef

*Attorney, Agent, or Firm*—Hill, Steadman & Simpson

[57] ABSTRACT

A novel joy stick in which arcuate shaped resistors are biased against conductive coil carried by a ball. The arcuate shaped resistors have electrical contacts that extend from them. Tactile feel is obtained by providing detent means that give the ball a suitable feel as it is moved.

6 Claims, 3 Drawing Sheets

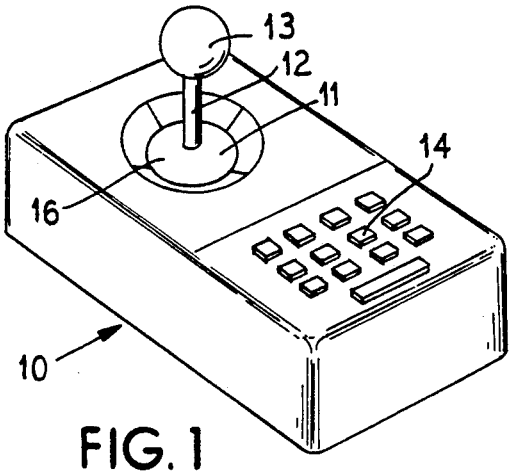
FIG. 1
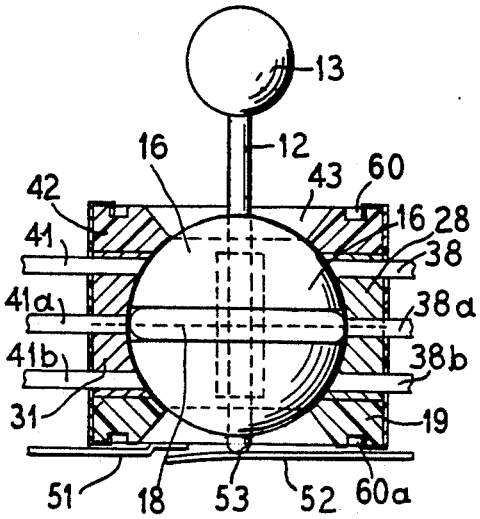
FIG. 2
FIG. 3
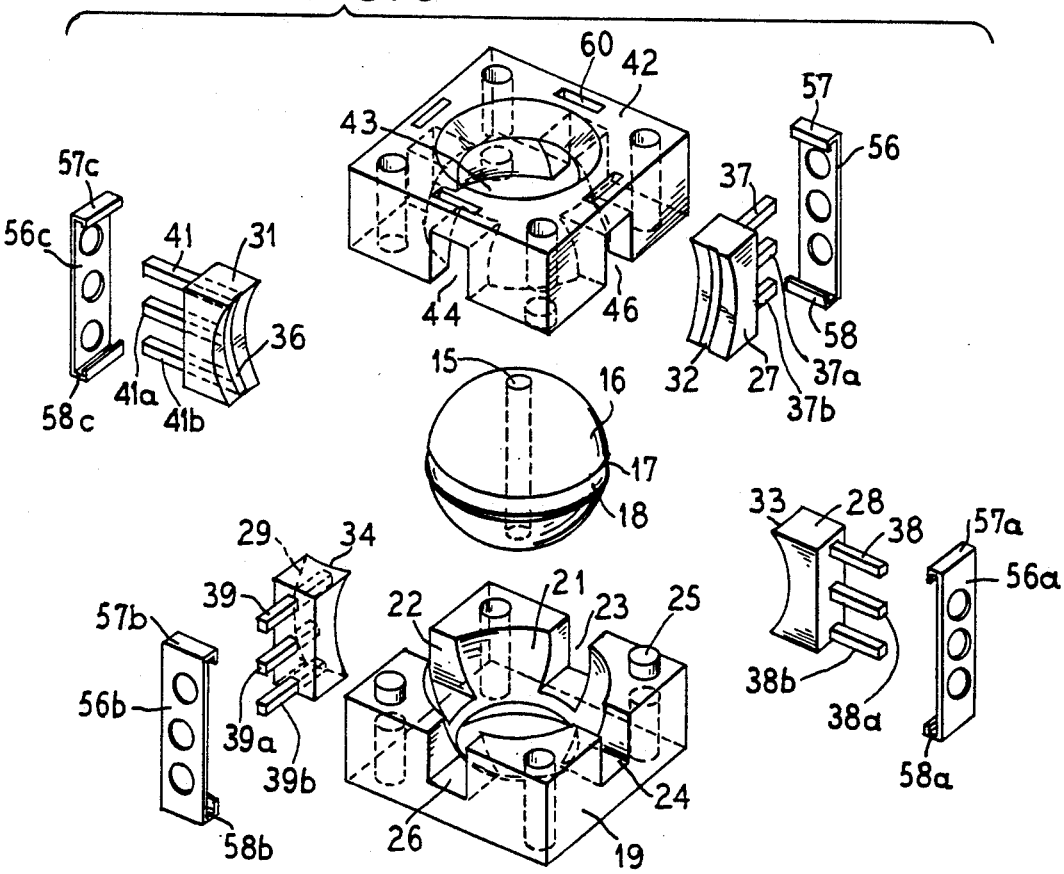

JOY STICK

BACKGROUND OF THE INVENTION

1. Field of the Invention

This invention relates in general to joy sticks and particularly to new improved embodiments of a joy stick.

2. Description of Related Art

U.S. Pat. No. 4,382,166 discloses joy sticks. See also my Pat. No. 5,087,904 to "Joy Stick".

SUMMARY OF THE INVENTION

The present invention relates to an improvement on a joy stick.

The first improvement is loading of a resistor element with a force. This is opposite to the normal potentiometer. Normally the contact-wiper applies force to the resistor. In the invention, my concept allows the ideal force to be applied to the contact interface or a minimum force which results in longer life. This is accomplished with an elastic (tension or compression) member such as a rubber band or cantilever beams also in compression or tension.

Secondly, joy sticks which are now being utilized in low power situations like remote controls have been primarily digital at the present time. The need for analog joy sticks exist. The benefit of analog is that many speeds can be attained which results in a user friendly device. The prior art problem is that there is no way to wake up the remote control from the sleep or power down mode. Thus, the remote would quickly lose its battery life if it did not go to sleep. Thus, in the invention, there are proposed several ways to wake up a remote or integrated circuit. One manner is to place on the bottom of the joy stick either a protrusion or an indentation at the very bottom of the ball. Thus, with a switch placed below, any angular displacement of the ball will cause the switch to change states. Then, the interrupt line of the integrated circuit recognizes this switch change of state and the integrated circuit powers up and the analog output of the joy stick is monitored for displacement.

Tactile feedback is also an important aspect to digital switches. In the present invention, tactile feedback is provided in the analog joy stick. This is accomplished by putting steps or grooves on the ball and having the cantilever beam forced or snapped into the various grooves. Thus, more than one groove will give multiple tactile feedbacks for various speeds.

The present invention discloses various embodiments with the joy stick.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 is a perspective view of the improved joy stick of the invention;

FIG. 2 is a sectional view through the joy stick of the invention;

FIG. 3 is an exploded view of the joy stick of the invention;

DETAILED DESCRIPTION OF THE PREFERRED EMBODIMENTS

Figure 4:
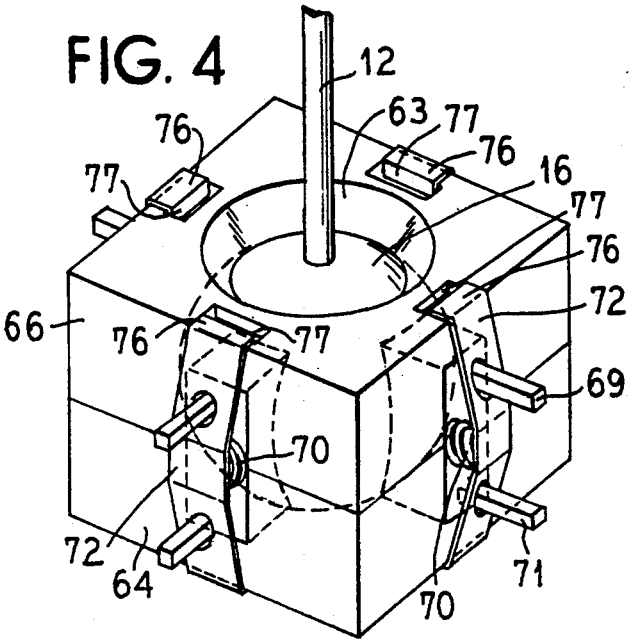
FIG. 4 is a perspective view of the second embodiment of the invention.

FIG. 1 illustrates a controller 10 which includes a joy stick 11 which has a ball 16 to which a handle shaft 12 is attached and a handle 13. FIGS. 2 and 3 illustrate the details of the joy stick ball 16 and the switch structure surrounding it.

As best shown in FIG. 3 which is an exploded view, the ball 16 is formed with a groove 17 in which is mounted an electrically conductive coil 18 which extends completely around the ball 16. The ball 16 is mounted between two plastic members comprising a lower plastic member 19 which is formed with an inner hemispherical surface 21 and an upper plastic member 42 formed with an upper hemispherical recess. An upper opening 43 extends through the upper member 42. The lower member 19 is formed with slots 22, 23, 24 and 26 in the outer side walls thereof and the upper plastic member 42 is formed with aligned slots such as slots 44 and 46 in the side walls. The ball 16 is mounted in the opening 21 and the corresponding opening in the member 42 and the upper and lower member are joined together by pins 25 which extend into aligned openings in the upper member 42 and lower member 19. Contact members 27, 28, 29 and 31 are received respectively in the slots of members 19 and 42. For example, contact member 28 is received in the slots 24 and 46 and has a curved face upon which a generally vertical resistive element 33 is mounted. Contact member 27 is similarly mounted and electrical contacts 37, **37*a* and 37*b* extend from the resistive element 32 at opposite ends in the middle thereof. Likewise the member 28 has an electrical contact 33 which is connected to the leads 38, 38*a* and 38*b*. The member 29 has electrical resistive path 34 which is connected to leads 39, 39*a* and 39*b* and the member 31 has an electrical contact path 36 which is connected leads 41, 41*a* and 41*b***.

A spring member 56 is formed with openings through which the leads 37, **37*a* and 37*b* extend and has ends 57 and 58 which are receivable in grooves 60 and a corresponding groove 60*a* in the lower member 19. The member 28 is held by spring member 56*a* which has upper and lower locking ends 57*a* and 58*a*. The member 29 is held in position by the spring 56***b* which has upper and lower locking ends 57*a* and 58*b* that are received in slots in the lower member 19 and upper member 42. The member 31 is held in position by a spring 56*c* which has upper and ends 57*c* and 58*c* receivable in slots.

A projection 53 of the handle 12 extends through the lower portion of the ball 16 and engages a first spring contact 52 attached to the lower portion 19. a second spring portion 51 is also connected to the lower portion 19. The projection 53 maintains the spring portions 51 and 52 out of engagement when the handle 12 is in the vertical position as shown in FIG. 2, but as the ball 16 is moved relative to the vertical, the projection 53 allows the contacts 51 and 52 to engage. As the ball is moved, the coil 18 moves on the arcuate-shaped resistors 32, 33, 34 and 36 so as to vary the resistance between the contacts such as contacts 38, 38*a* and 38*b* illustrated in FIG. 2 as well as contacts 41, 41*a* and 41*b* illustrated in FIG. 2. It is to be realized, of course, that suitable voltages are applied to the various contacts 38, 38*a* and 38*b* so as to vary the potentials between them so that such variations can be detected as the ball 16 is moved. The springs 56, 56*a*, 56*b* and 56*c* provide the biasing forces for holding the resistors 32, 33 and 34 and 36 against the electrically conducting coil 18.

Figure 5:
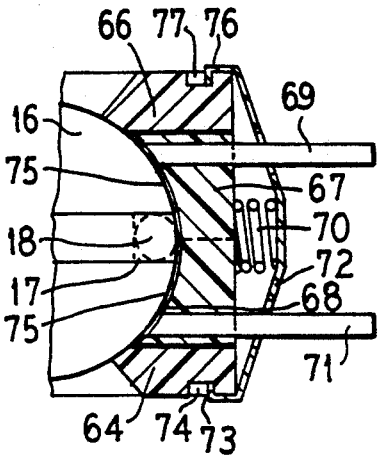
FIG. 5 is a cut-away sectional view of the second embodiment of the invention.

FIGS. 4 and 5 illustrate a modified form of the invention wherein the ball 16 is mounted between a lower member 64 and an upper member 66' which is held together by curved spring members 72 which are mounted to each of the four sides of the joy stick. Curved ends 73 and 76 of this spring 70 are received in grooves 74 and 77, respectively, formed in the upper and lower members 66' and 64'. The spring members 72 are attached on all four sides of the upper and lower members 64' and 66' as shown in FIG. 4 and springs 70 fit between the center portions of the spring members 72 and contact members 67 which carry arcuate resistive paths 65 that are biased by the spring 72 against the coil 80 of ball 16. A pair of contacts 69 and 7 are connected to opposite ends of the resistive path 75 and extend through the spring member 72 as illustrated in FIG. 5.

As the ball 16 is moved by the handle 12, the coil 18 moves relative to the conductive path 75 on the member 67 and varies the resistance between the contacts 69 and 71.

Figure 6:
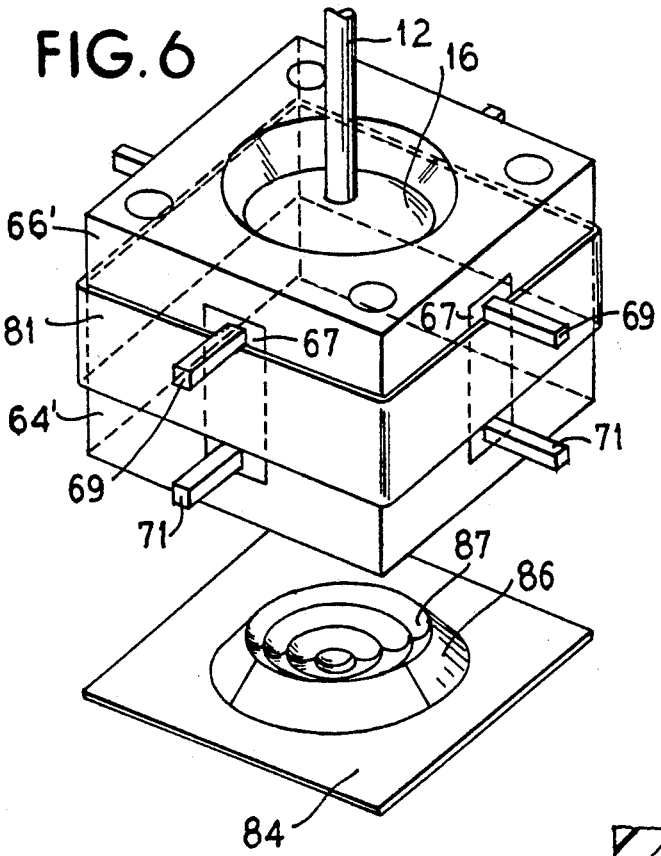
FIG. 6 illustrates a third embodiment of the invention.
Figure 7:
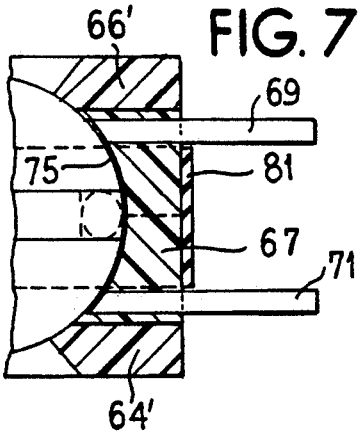
FIG. 7 is a sectional view through the third embodiment of the invention.
Figure 8:
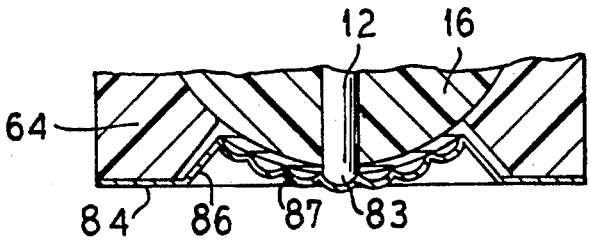
FIG. 8 illustrates another embodiment of the invention.

FIGS. 6, 7 and 8 illustrate a third embodiment wherein the upper and lower members 64 and 66 may be joined with a suitable adhesive and an elastic or rubber band 81 extends around the upper and lower members 64 and 66 so as to bias the members 67 against the coil spring 18. So as to provide a tactile feel, a bottom member 84 is attached to the bottom of portion 64 and has a raised conical portion 86 that is formed with annular indentations 87 that engages the end 83 of the shaft 12 so that as the ball 16 is moved, the end 83 will move from one indentation 87 to another one and, thus, provide a tactile feel to the operator as he moves the ball 16.

Figure 9:
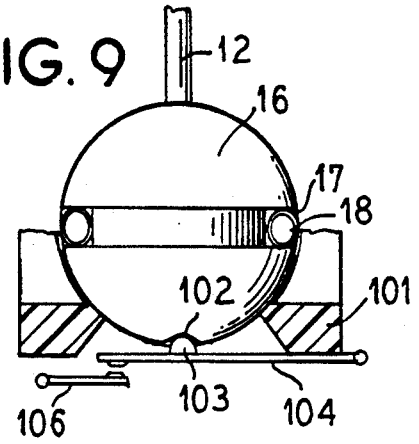
FIG. 9 illustrates another embodiment of the invention.

FIG. 9 illustrates a modification wherein the lower portion 101 which supports the ball 16 has a first spring portion 104 attached thereto which has a projection 103 that is received in an indentation 102 formed in the ball 16. A second switch portion 106 is spaced from the switch contact 104 such that when the projection 103 is in the indentation 102, the switch is open. When the ball 16 is moved by moving the handle 12 such that the projection 103 moves out of the indentation 102 the projection 103 then moves the contact 104 so that it engages contact 106 to close the electrical circuit between members 104 and 106.

Figure 10:
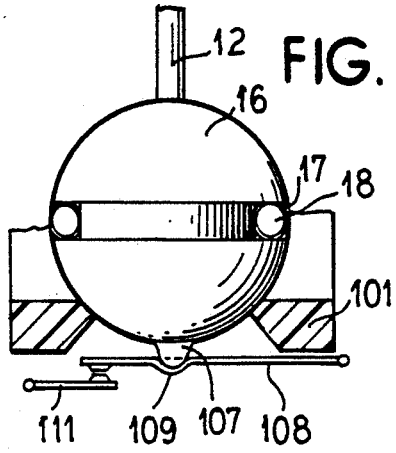
FIG. 10 illustrates another embodiment of the invention.
Figure 12:
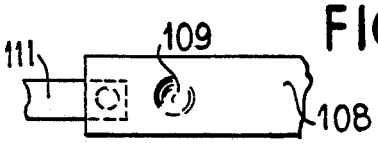
FIG. 12 is a bottom plan view of the switch shown in FIG. 10.

FIG. 10 illustrates another embodiment wherein the lower portion 101 which supports the ball 16 carries a switch contact 108 that is formed with a depression 109 and in which a projection 107 attached to the lower portion of the ball is received. When the projection 107 is in the depression 109, the contact 108 makes electrical contact with second contact 111. When the ball 16 is moved by moving the handle 12, the projection 107 moves out of the recess 109 so as to allow the contact 108 to move out of engagement with contact 111 due to the spring bias provided by the contact 108. FIG. 12 is a bottom plan view of the switch 111 and the depression 109.

Figure 11:
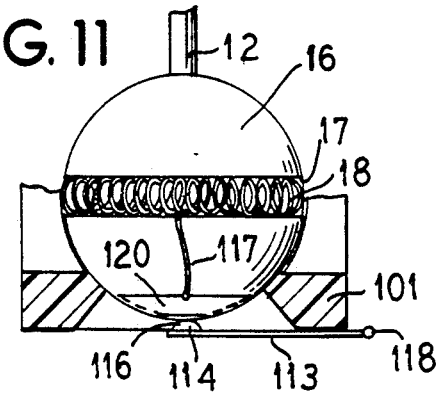
FIG. 11 illustrates another embodiment of the invention.

FIG. 11 illustrates an embodiment wherein a switch contact 113 is attached to the lower portion 101 and has a contact 118 and carries a projection 114 which is receivable in a projection 116 formed in electrical contact cap member 120. An electrical lead 117 connects the electrical conductive cap member 120 with the coil 18. Thus, the coil 18 is connected to contact 118 through the conductor 117 and a tactile feel is obtained when the handle 12 is moved and the projection 114 moves out of the recess 16.

Figure 13:
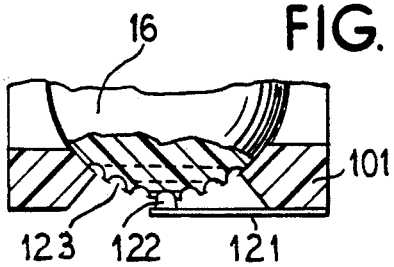
FIG. 13 is a partially cut-away sectional view of the invention.

FIG. 13 illustrates an embodiment wherein the ball 16 is formed with a lower portion that has indentations 123 into which a projection 122 is received. A spring contact 121 carries the projection 122 and has its other end connected to the lower portion 101. As the ball 16 is moved, tactile feel of the movement is obtained due to the projection 122 and the recesses 123.

Figure 14:
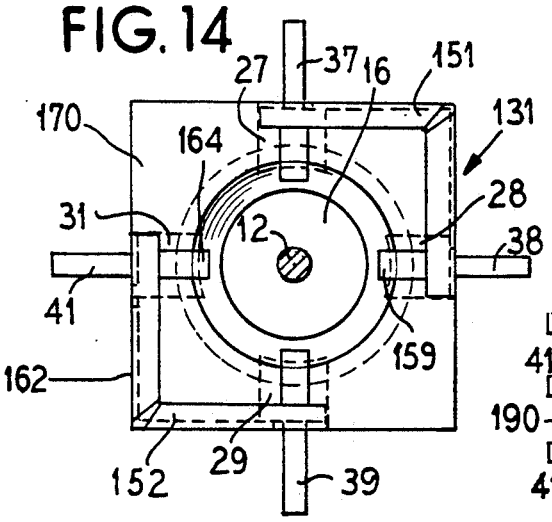
FIG. 14 illustrates another embodiment of the invention.
Figure 15:
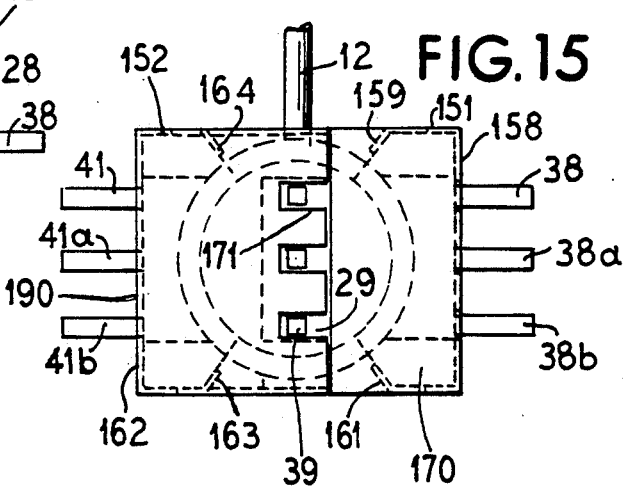
FIG. 15 illustrates another embodiment of the invention.

FIGS. 14 and 15 illustrate another embodiment of the invention 131 wherein the ball is mounted in plastic ball receiving member 170 and the arcuate resistive carrying members 27, 28, 29 and 31 such as illustrated in FIG. 3 are biased in toward the coil 18 by L-shaped members 151 and 152. FIG. 14 illustrates how the L-shaped members 151 and 152 engage the members 27, 28, 29 and 31 and bias them in toward the coil 18. As shown in FIG. 15, member 152 has bent in portions 164 and 163 which are received in slots in the body member 170 to hold the member 152 on the body member. Member 151 has portions 159 and 161 that are received in slots to hold it to the ball receiving member 170. Spring biasing fingers 171 formed on member 152 bias the member 29 inwardly so that the arcuately conducting member 34 engage the coil 18.

It is seen that the present invention provides a new and novel improved joy stick and although the invention has been described with respect to preferred embodiments, it is not to be so limited as changes and modifications can be made which are within the full intended scope of the invention as defined by the appended claims.

I claim as our invention:

1. A joy stick comprising, lower and upper ball receiving members, a ball mounted between said lower and upper ball receiving members, a conductive path attached about the periphery of the ball, a slot formed in said lower and upper ball receiving members, and a contact member receivable in said slot, said contact member formed with an arcuate resistor which is engageable with said conductive path attached to said ball, including spring biasing means connected to said lower and upper ball receiving members and to said contact member to bias it toward said conductive path, including a plurality of slots in said lower and upper members, a plurality of contact members receivable in said plurality of slots and each formed with arcuate resistors engageable with said conductive path on said ball, and said spring biasing means biasing said plurality of contact members toward said conductive path, and wherein said ball is formed with an annular groove, and said conductive path comprises a coil of electrical conductive material mounted in said groove.

2. A joy stick according to claim 1 wherein said spring biasing means is a metal spring.

3. A joy stick according to claim 1 wherein said biasing means is an elastic band.

4. A joy stick according to claim 1 including a projection attached to said ball and a detent means connected to said lower ball receiving member and engageable with said projection to give a tactile feel when said ball is moved.

5. A joy stick according to claim 1 including a depression formed in said ball and a detent means receivable in said depression to produce a tactile feel as said ball is moved and a switch integrally formed with said detent means and said switch is in the open condition when said detent is received in said depression.

6. A joy stick according to claim 5 wherein said detent is an electrical switch.

* * * * *